US008251094B2

(12) United States Patent
Lin

(10) Patent No.: US 8,251,094 B2
(45) Date of Patent: Aug. 28, 2012

(54) WATER TAP

(76) Inventor: Chen-Chang Lin, Shengang Township (TW)

( * ) Notice: Subject to any disclaimer, the term of this patent is extended or adjusted under 35 U.S.C. 154(b) by 268 days.

(21) Appl. No.: 12/838,493

(22) Filed: Jul. 18, 2010

(65) Prior Publication Data

US 2012/0012203 A1 Jan. 19, 2012

(51) Int. Cl.
*F16K 27/00* (2006.01)
*E03C 1/04* (2006.01)

(52) U.S. Cl. ..... 137/601.18; D23/255; 4/678

(58) Field of Classification Search ..... 4/661, 675–678; 137/601.18, 603, 801; D23/238–240, 255; 239/17, 24, 25, 589, 590.5, 504
See application file for complete search history.

(56) References Cited

U.S. PATENT DOCUMENTS

| | | | | |
|---|---|---|---|---|
| 1,862,029 | A * | 6/1932 | Moore | 251/156 |
| D378,415 | S * | 3/1997 | Irwin et al. | D24/177 |
| D444,859 | S * | 7/2001 | Slothower | D23/255 |
| D444,860 | S * | 7/2001 | Slothower | D23/255 |
| 6,694,544 | B2 * | 2/2004 | Piatt | 4/661 |

* cited by examiner

*Primary Examiner* — Stephen M Hepperle
*Assistant Examiner* — Kevin Barss
(74) *Attorney, Agent, or Firm* — Hershkovitz & Associates LLC

(57) ABSTRACT

The water tap has a tap stand and a storage frame. The tap stand is has a flowing channel formed through the tap stand. The storage frame is mounted on the tap stand and has a flowing groove and a storage hole. The flowing groove is annular and formed in a top surface of the storage frame and communicates with the flowing channel of the tap stand. The storage hole is formed through the storage frame to provide a storage function.

9 Claims, 6 Drawing Sheets

WATER TAP

BACKGROUND OF THE INVENTION

1. Field of the Invention

The present invention relates to a water tap, and more particularly to a water tap with a storage frame to provide a storage function and keep a sink neat.

2. Description of Related Art

A convention water tap is set on a sink and communicated to the water pipe of the water supply and provides functions of controlling the release of the water and adjusting the flow rate of the water. The water tap is generally set on the sink in a restroom or a kitchen. Many toiletries like a rinsing cup, a toothpaste, a toothbrush or a hand washing cream are randomly put on the sink near the water tap in order to use conveniently.

However, because the convention water tap does not have any storage function, and the toiletries are put randomly on the sink near the water tap is not neat and may be overturned or dropped down and stain the ground of the restroom or kitchen.

To overcome the shortcomings, the present invention tends to provide a water tap to mitigate or obviate the aforementioned problems.

SUMMARY OF THE INVENTION

The main objective of the present invention is to provide a water tap with a storage frame to provide a storage function and keep a sink clean.

The water tap has a tap stand and a storage frame. The tap stand is has a flowing channel formed through the tap stand. The storage frame is mounted on the tap stand and has a flowing groove and a storage hole. The flowing groove is annular and formed in a top surface of the storage frame and communicates with the flowing channel of the tap stand. The storage hole is formed through the storage frame to provide a storage function.

Other objects, advantages and novel features of the invention will become more apparent from the following detailed description when taken in junction with the accompanying drawings.

DETAILED DESCRIPTION OF PREFERRED EMBODIMENT

Figure 1:
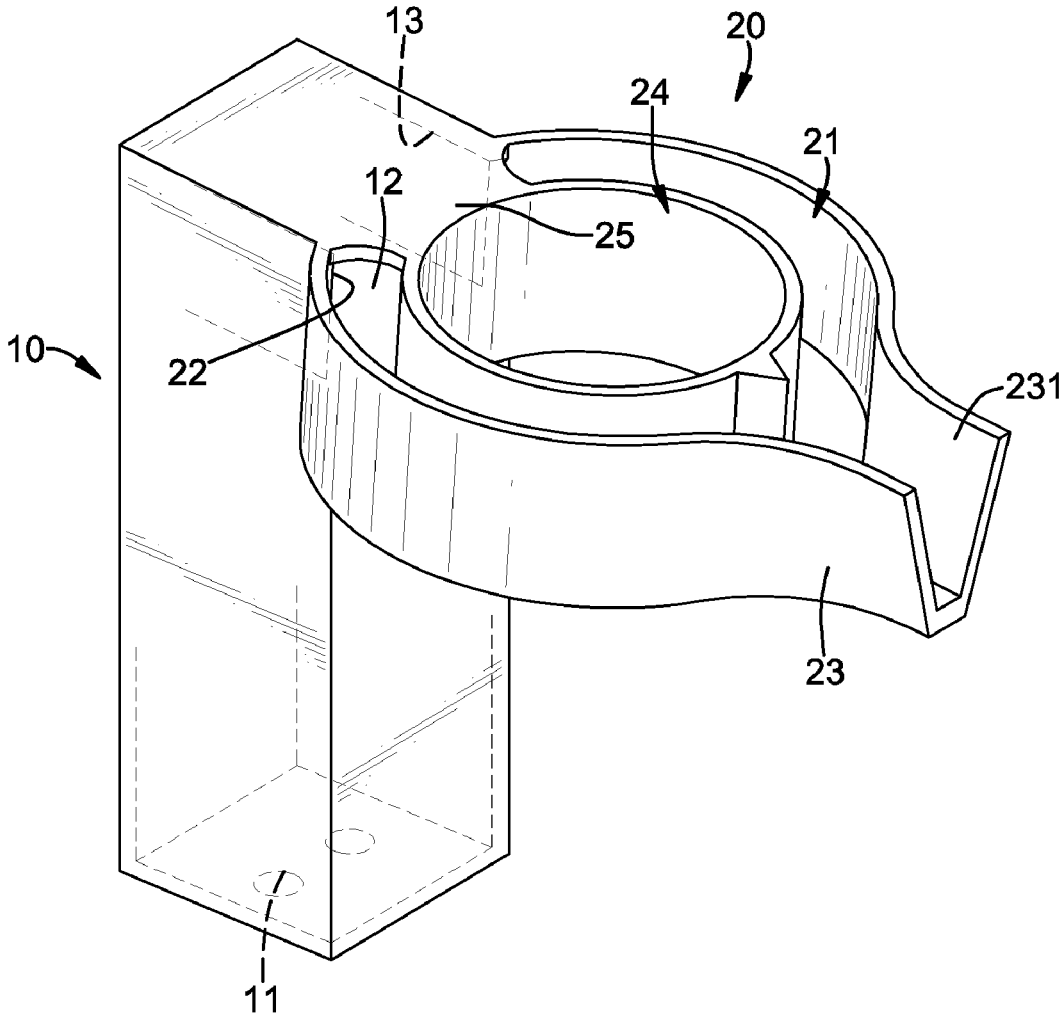
FIG. 1 is a perspective view of a water tap in accordance with the present invention.
Figure 2:
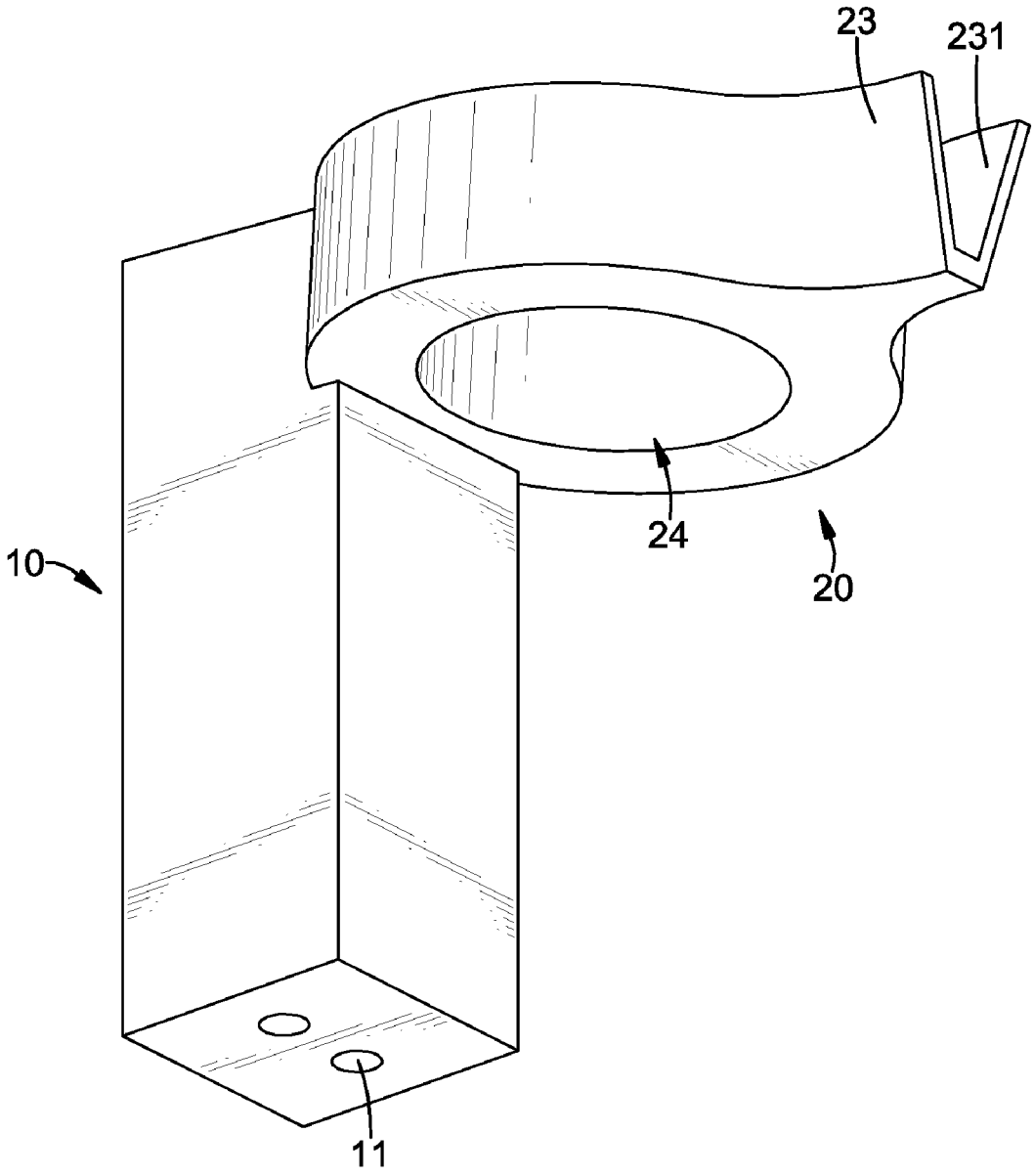
FIG. 2 is another perspective view of the water tap in FIG. 1.
Figure 3:
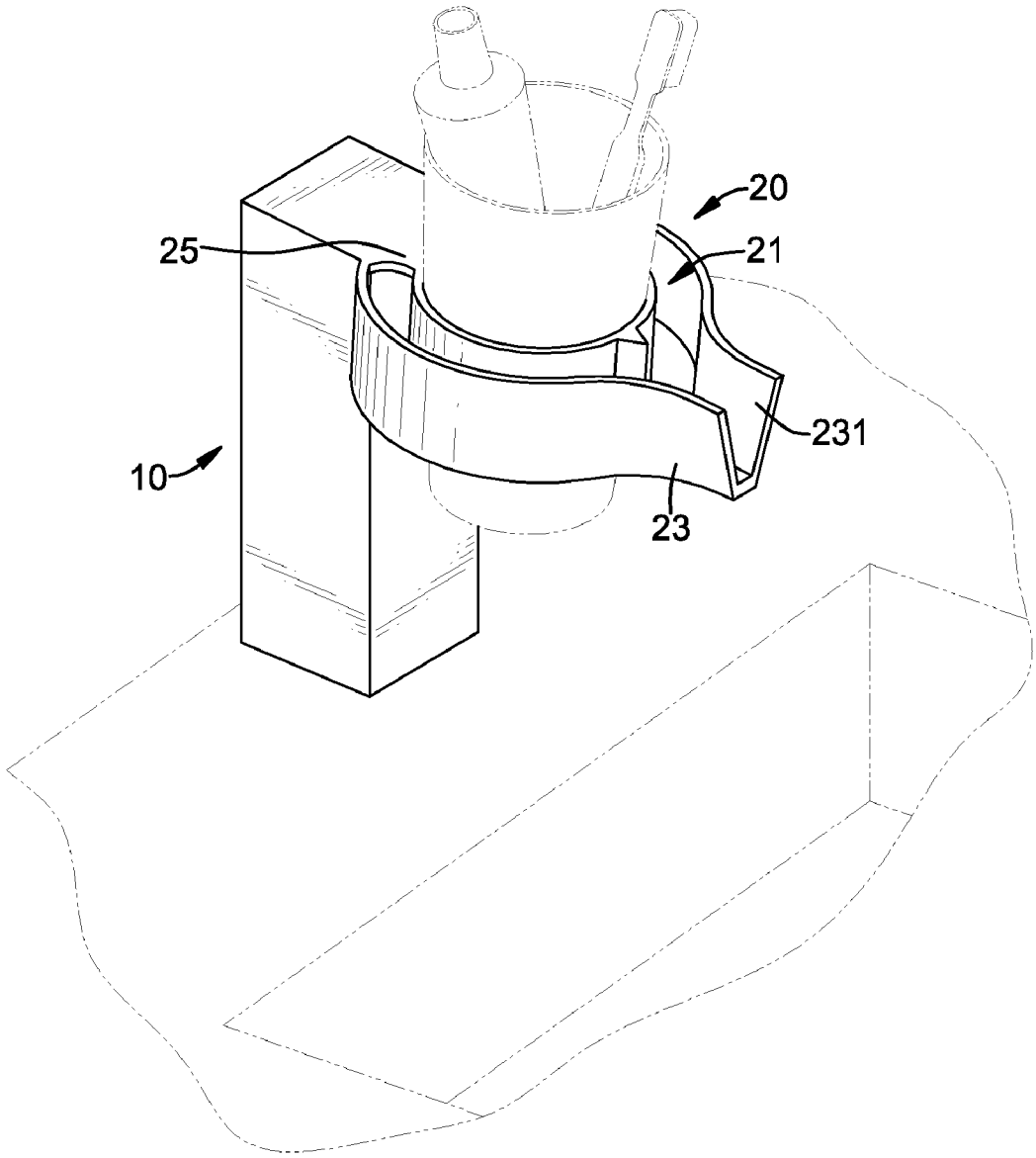
FIG. 3 is an operational perspective view of the water tap in FIG. 1 showing a using condition of the water tap.
Figure 4:
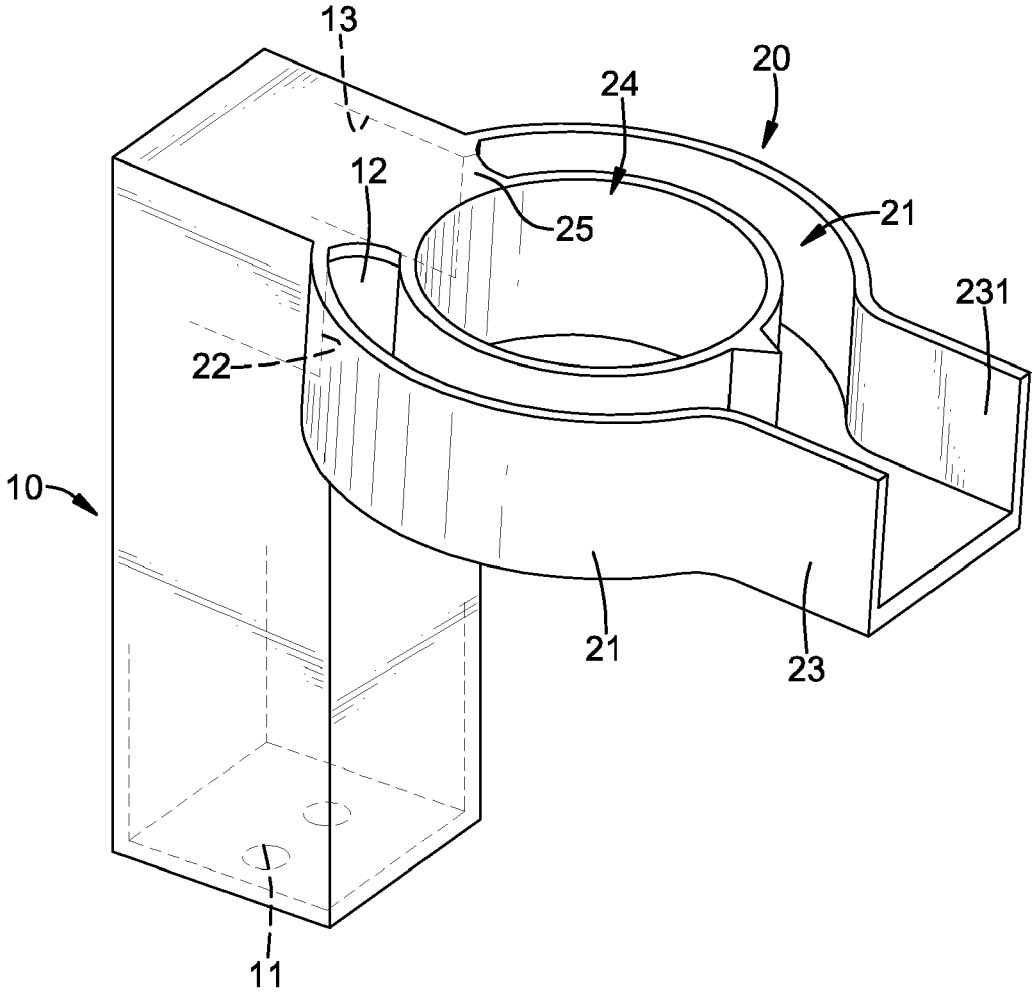
FIG. 4 is a perspective view of another embodiment of a water tap in accordance with the present invention.
Figure 5:
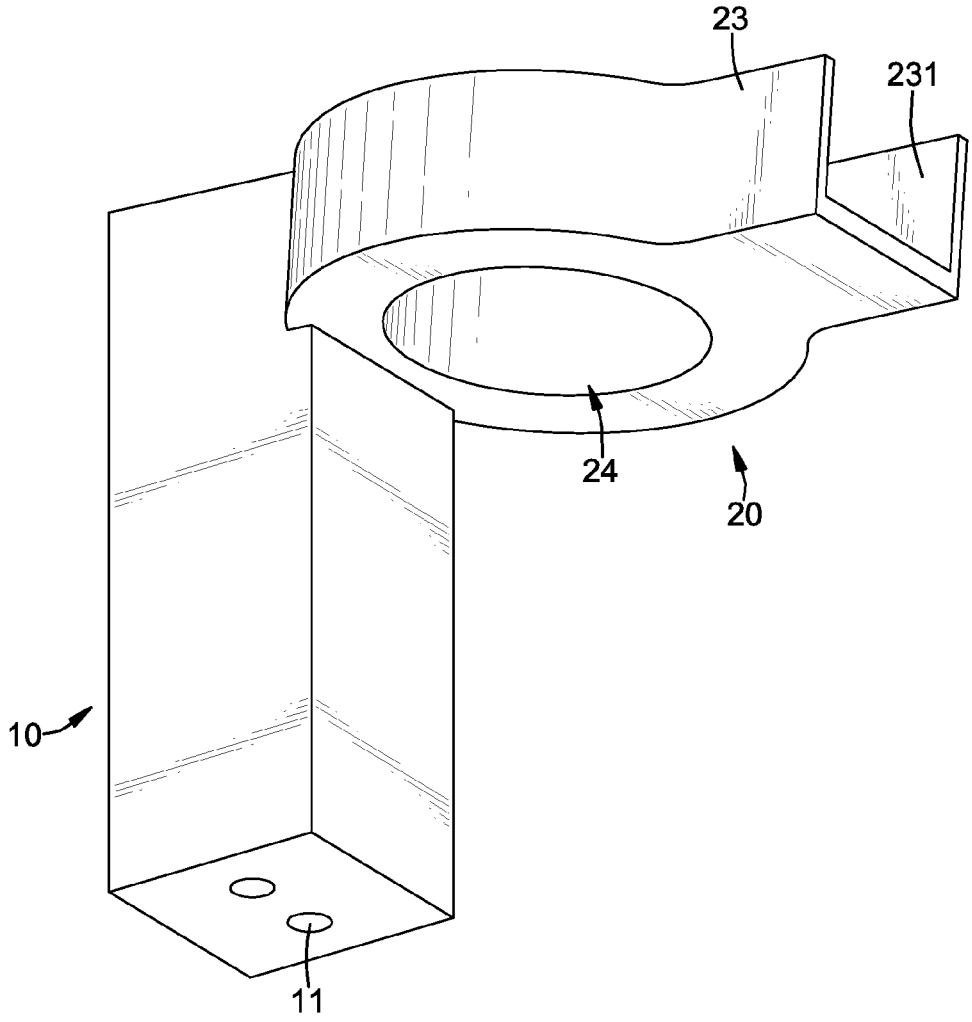
FIG. 5 is another perspective view of the water tap in FIG. 4.
Figure 6:
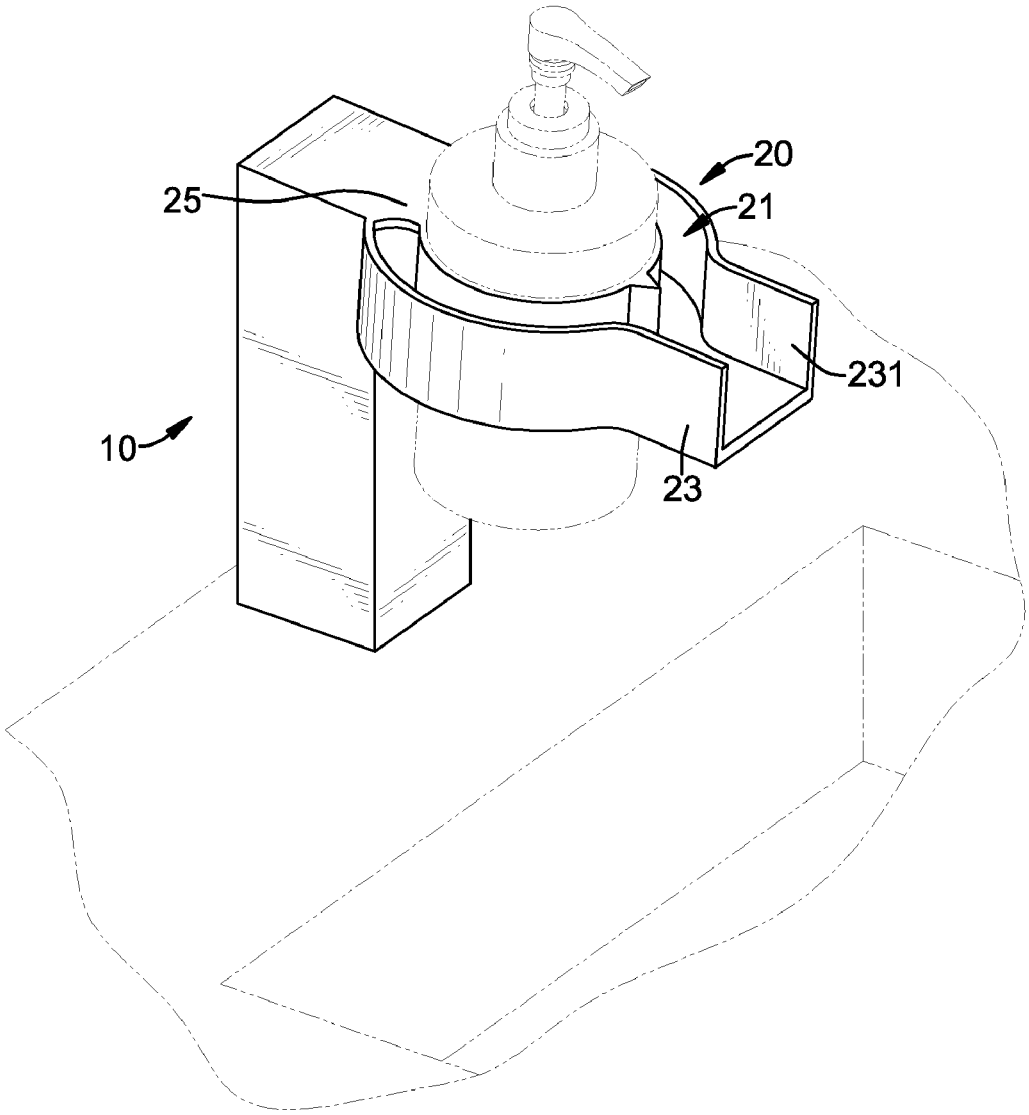
FIG. 6 is an operational perspective view of the water tap in FIG. 4 showing a using condition of the water tap.

With reference to FIGS. 1 to 6, a water tap in accordance with the present invention has a tap stand 10 and a storage frame 20. The tap stand 10 is hollow and has a bottom end, a top end, an inlet 11, an outlet 12 and a flowing channel 13.

The inlet 11 is formed through the bottom end of the tap stand 10 and may comprise a pair of circle holes. The outlet 12 is formed through the top end of the tap stand 10 and may be a rectangular hole. The flowing channel 13 is formed through the tap stand 10 from the bottom end to the top end and communicates with the inlet 11 and the outlet 12 of the tap stand 10.

The storage frame 20 is annular and mounted on the top end of the tap stand 10 at a position in which the outlet 12 is defined and has a top surface, a flowing groove 21, an inner wall, an outer wall, an entering slot 22, an outfall 23 and a storage hole 24, and may optionally have a connecting tab 25.

The flowing groove 21 is annular and formed in the top surface of the storage frame 20. The inner wall and the outer wall of the storage frame 20 are respectively defined in two sides of the flowing groove 21 and surround the flowing groove 21. The entering slot 22 is formed through the outer wall of the storage frame 20, communicates with the flowing groove 21 and corresponds to and communicates with the outlet 12 of the tap stand 10.

The outfall 23 is formed on and protrudes from the outer wall of the storage frame 20 opposite to the entering slot 22 and has a falling slot 231. The falling slot 231 is formed in the outfall 23 and communicates with the flowing groove 21 and makes the outfall 23 shaped as a V-shaped cross section or a U-shaped cross section. The storage hole 24 is circular and formed through the storage frame 20 and is shaped and surrounded by the inner wall of the storage frame 20. The storage hole 24 provides a storage function to hold a rinsing cup or a hand washing cream. The toothpaste and toothbrush may be put in the rinsing cup to keep the sink neat. The shape of the storage hole 24 is unlimited and may be circular, rectangular or semicircular to fit various shapes of the rinsing cups or some other toiletries.

The connecting tab 25 is mounted between the inner wall and the outer wall and connected to the top end of the tap stand 10 and covers a part of the flowing groove 21 beside the outlet 12 of the tap stand 10. The connecting tab 25 provides a sufficient strength to connect the tap stand 10 and the storage frame 20.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A water tap comprising:

a tap stand being hollow and having
- a bottom end;
- a top end;
- an inlet formed through the bottom end of the tap stand;
- an outlet formed through the top end of the tap stand; and
- a flowing channel formed through the tap stand and communicating with the inlet and the outlet of the tap stand; and a storage frame mounted on the top end of the tap stand and having
- a top surface;
- a flowing groove being annular and formed in the top surface of the storage frame;
- an inner wall and an outer wall respectively defined in two sides of the flowing groove and surround the flowing groove;

an entering slot formed through the outer wall of the storage frame and respectively communicating with the flowing groove and the outlet of the tap stand;

an outfall formed on and protruding from the outer wall of the storage frame and having a falling slot communicating with the flowing groove; and a storage hole formed through the storage frame and surrounded by the inner wall of the storage frame to provide a storage function.

2. The water tap as claimed in claim 1, wherein the storage frame is annular; and the storage hole is circular.

3. The water tap as claimed in claim 2, wherein the storage frame further has a connecting tab mounted on the inner wall and the outer wall beside the outlet of the tap stand and connected to the top end of the tap stand.

4. The water tap as claimed in claim 3, wherein the outfall is shaped as a V-shaped cross section.

5. The water tap as claimed in claim 3, wherein the outfall is shaped as a U-shaped cross section.

6. The water tap as claimed in claim 4, wherein the outfall is formed on and protrudes from the outer wall of the storage frame opposite to the entering slot.

7. The water tap as claimed in claim 5, wherein the outfall is formed on and protrudes from the outer wall of the storage frame opposite to the entering slot.

8. The water tap as claimed in claim 1, wherein the outfall is shaped as a V-shaped cross section.

9. The water tap as claimed in claim 1, wherein the outfall is shaped as a U-shaped cross section.

* * * * *